US011477586B2

(12) United States Patent
Van Gerwen

(10) Patent No.: US 11,477,586 B2
(45) Date of Patent: Oct. 18, 2022

(54) IMPLANT SYSTEM

(71) Applicant: Peter B. J. Van Gerwen, Keerbergen (BE)

(72) Inventor: Peter B. J. Van Gerwen, Keerbergen (BE)

(73) Assignee: Cochlear Limited, Macquarie University (AU)

( * ) Notice: Subject to any disclaimer, the term of this patent is extended or adjusted under 35 U.S.C. 154(b) by 394 days.

(21) Appl. No.: 16/819,809

(22) Filed: Mar. 16, 2020

(65) Prior Publication Data

US 2020/0260201 A1 Aug. 13, 2020

Related U.S. Application Data

(60) Division of application No. 15/006,277, filed on Jan. 26, 2016, now Pat. No. 10,595,141, which is a continuation of application No. 13/256,137, filed as application No. PCT/AU2010/000283 on Mar. 11, 2010, now Pat. No. 9,247,357.

(30) Foreign Application Priority Data

Mar. 13, 2009 (AU) ..... 2009901073

(51) Int. Cl.
*H04R 25/00* (2006.01)
*H04R 3/00* (2006.01)

(52) U.S. Cl.
CPC ..... *H04R 25/606* (2013.01); *H04R 25/305* (2013.01); *H04R 3/005* (2013.01); *H04R 25/554* (2013.01); *H04R 25/603* (2019.05); *H04R 2225/41* (2013.01); *H04R 2225/61* (2013.01); *H04R 2460/05* (2013.01)

(58) Field of Classification Search
CPC .. H04R 25/606; H04R 25/305; H04R 25/603; H04R 3/005; H04R 25/554; H04R 2225/41; H04R 2225/61; H04R 2460/05
USPC ..... 381/312
See application file for complete search history.

(56) References Cited

U.S. PATENT DOCUMENTS

| | | | | |
|---|---|---|---|---|
| 2008/0144840 | A1* | 6/2008 | Goldstein | G01H 3/14 381/56 |
| 2009/0097681 | A1* | 4/2009 | Puria | H04R 1/265 381/318 |
| 2009/0129619 | A1* | 5/2009 | Nordahn | H04R 25/70 381/328 |
| 2010/0135502 | A1* | 6/2010 | Keady | A61B 5/6817 381/72 |
| 2011/0178438 | A1* | 7/2011 | Van Gerwen | H04R 25/606 600/587 |

* cited by examiner

*Primary Examiner* — Sean H Nguyen
(74) *Attorney, Agent, or Firm* — Pilloff Passino & Cosenza LLP; Martin J. Cosenza

(57) ABSTRACT

A compensation system for an implantable actuator is disclosed where the implantable actuator includes a sealed housing containing a driving arrangement for the actuator. The compensation system includes an external pressure sensor for measuring an external pressure outside of the sealed housing and a compensation module for determining a compensation factor for the implantable actuator based on the external pressure. In one embodiment, the compensation is directed to a direct acoustic cochlear stimulation (DACS) implantable actuator.

20 Claims, 6 Drawing Sheets

IMPLANT SYSTEM

CLAIM OF PRIORITY

The present application is a Continuation application of U.S. patent application Ser. No. 13/256,137, filed Oct. 25, 2011, naming Peter B. J. Van Gerwen as an inventor, which is a National Stage of WIPO Application No. PCT/AU2010/000283, filed Mar. 11, 2010, which claims priority to Australia Patent Application No. 2009901073, filed Mar. 13, 2009. The entire contents of these applications are incorporated herein by reference in their entirety.

TECHNICAL FIELD

The present invention relates to an implantable actuator. In a particular form, the present invention relates to an implantable actuator for direct stimulation of the middle and inner ear.

INCORPORATION BY REFERENCE

The entire contents of the following document are hereby incorporated by reference:

PCT Application No. PCT/AU2005/001801 (WO 2006/058368)

BACKGROUND

In those circumstances where a subject has conductive or mixed hearing loss due to inefficient sound transmission through the external and/or middle ear one system, one potential mode of treatment is direct acoustic cochlear stimulation (DACS). This involves the use of an implantable medical device incorporating an actuator which directly stimulates the inner ear fluid (perilymph) by simulating the operation of a normally functioning middle ear. In this way, a DACS actuator can circumvent damage to the outer and/or middle ear of a recipient to treat hearing loss.

As the DACS actuator is essentially replicating in whole or in part the operation of the middle ear, these devices are necessarily extremely finely balanced electromechanical systems. One area of sensitivity of these devices is their susceptibility to variations in the surrounding or environmental pressure conditions such as would be experienced where there is change of altitude or weather conditions. Accordingly, while a DACS actuator may be optimised for operation at sea level and normal weather conditions, a recipient may find the performance of the actuator affected by variations in these conditions leading to degradation in the performance of the hearing aid device.

It is desirable to improve upon any one or more of the above identified shortcomings.

SUMMARY

In a first aspect there is provided a compensation system for an implantable actuator; the implantable actuator having a sealed housing containing a driving arrangement for the actuator; the compensation system including:

- an external pressure sensor for measuring an external pressure outside of the sealed housing; and
- a compensation module for determining a compensation factor for the implantable actuator based on the external pressure.

In another form, the compensation factor is for the driving arrangement of the implantable actuator.

In another form, the compensation system further includes an internal pressure sensor for measuring an internal pressure within the sealed housing.

In another form the external pressure sensor and the internal pressure sensor are combined as a differential pressure sensor.

In another form, the compensation module determines a compensation factor based on both the external pressure and the internal pressure.

In another form, the compensation module determines a compensation factor based on the internal pressure.

In another form, the compensation module determines a compensation factor in the form of a modified transfer function for the implantable actuator.

In another form, the modified transfer function relates to the driving arrangement of the actuator.

In another form, the external pressure sensor is an implantable component.

In another form, the external pressure sensor is integrated into one or more of the implantable components of the implantable actuator.

In another form, the external pressure sensor is an external component configured to be used externally to the recipient of the implantable actuator.

In another form, the implantable actuator further includes one or more external components configured to be used externally to the recipient of the implantable actuator, and wherein the external pressure sensor is integrated into one or more of the external components of the implantable actuator.

In another form, the external pressure sensor is configured to be used remotely from the recipient of the implantable actuator and external pressure information is provided by a wireless link.

In another form, the implantable actuator is a direct acoustic cochlear stimulation (DACS) actuator.

In a second aspect there is provided an implantable actuator including the compensation system of the first aspect.

In a third aspect there is provided a method for compensating an implantable actuator for pressure variation, the implantable actuator having a sealed housing containing a driving arrangement for the actuator, the method including the steps of:

- measuring an external pressure outside of the sealed housing; and
- determining a compensating factor for the driving arrangement, the compensating factor based on the external pressure.

In another form, the compensation factor is for the driving arrangement of the implantable actuator.

In another form, the method further includes measuring an internal pressure within the sealed housing.

In another form, determining a compensation factor includes basing the compensation factor on both the external pressure and the internal pressure.

In another form, determining a compensation factor includes basing the compensation factor on the internal pressure.

In another form, the compensation factor is in the form of a modified transfer function for the implantable actuator.

In another form, the modified transfer function relates to the driving arrangement of the actuator.

In a fourth aspect there is provided a compensation system for an implantable actuator; the implantable actuator having a sealed housing containing a driving arrangement for the actuator; the compensation system including:

external pressure measurement means for measuring an external pressure outside of the sealed housing; and compensation means for determining a compensation factor for the implantable actuator based on the external pressure.

BRIEF DESCRIPTION OF THE DRAWINGS

Illustrative embodiments will be discussed with reference to the accompanying drawings wherein.

In the following description, like reference characters designate like or corresponding parts throughout the several views of the drawings.

DETAILED DESCRIPTION

Before describing illustrative embodiments of the compensation system and method, it is convenient to describe briefly the overall construction and operation of a DACS actuator which may be adapted to incorporate the compensation system and method.

Figure 1:
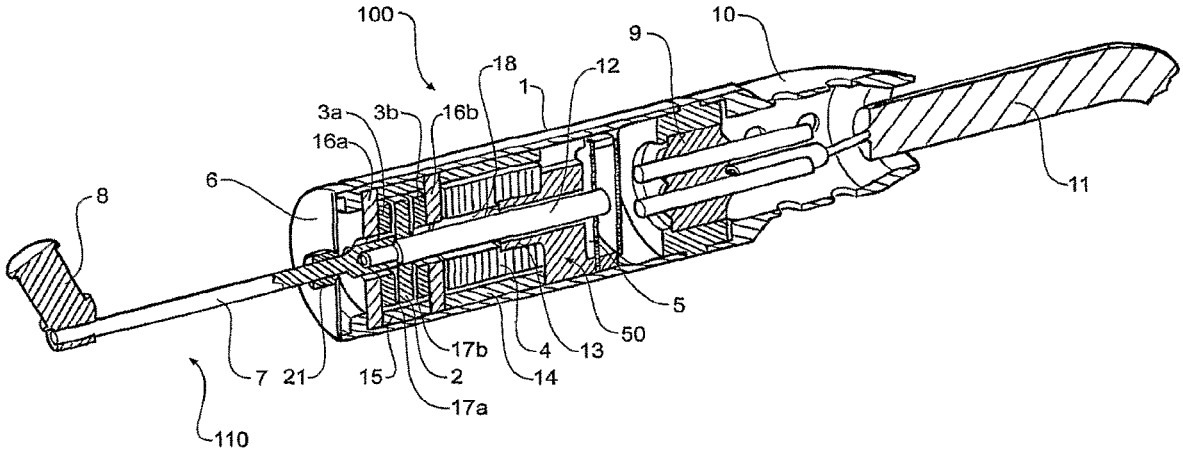
Figure 1 (prior art)
FIG. 1 is a perspective sectional view of the interior components of a prior art implantable DACS actuator.
Figure 2:
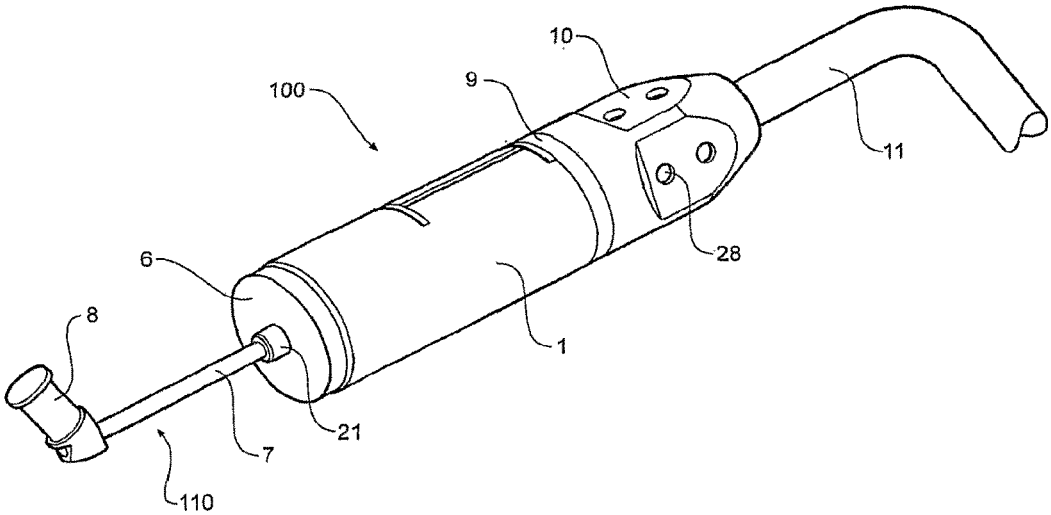
Figure 2 (prior art)
FIG. 2 is a composite perspective view of the DACS actuator as illustrated in FIG. 1.

Referring now to FIGS. 1 and 2, there are shown perspective and composite views depicting the components of an implantable DACS actuator 100 incorporating an electromechanical driving arrangement 50. DACS actuator 100 includes a housing 1 formed from titanium tubing that is substantially cylindrical and of circular cross section. DACS actuator 100 further includes a titanium diaphragm 6, a titanium ring 21 and a multi-pin feedthrough 9 which are joined by hermetic laser welds. Coupling rod 7, which is part of the moving mechanical output structure 110 of electromechanical driving arrangement 50, is placed in ring 21 and is hermetically welded to it. This assembly provides a hermetically closed housing 1 that is suitable for implantation in the human body.

Lead 11 which carries the input signal to electromechanical driving arrangement 50 is connected to feedthrough 9. To protect the connection site of the lead 11, electromechanical driving arrangement 50 may be covered by a silicone filled titanium cap 10. In this embodiment directed to a hearing aid device, the titanium cap 10 provides multiple flat surface regions to allow secure manipulation of the device during implantation with surgical tweezers or tongs. The titanium cap 10 also has a conical shape that provides mechanical transition between the small diameter of the lead 11 and larger diameter of the titanium housing 1.

Armature 2, shaft 12 and coupling rod 7 form the moving part of DACS actuator 100. As armature 2 and shaft 12 form part of the magnetic circuits which drive electromechanical driving arrangement 50 they are made of soft magnetic alloys. Shaft 12 is made of titanium to enable hermetic closing of the actuator by welding it to a ring 21. The resulting moving structure is elastically supported at one side by a diaphragm 6, which performs the function of a restoring spring. As such, diaphragm 6 prevents magnetic snap over. On the other side, shaft 12 is supported in the longitudinal direction by a spring bearing 5 having a spring constant sufficient to provoke, together with diaphragm 6, the demanded dynamic characteristic of this spring-mass structure.

The armature 2 is centred between two permanent magnets 3*a* and 3*b*, thereby forming two working gaps 17*a* and 17*b* between armature 2 and magnets 3*a* and 3*b* respectively. Both magnets 3*a* and 3*b* are polarized in the same direction substantially in parallel to the actuator axis and the direction of movement of shaft 12, and provide polarizing flux in working gaps 17*a* and 17*b* that extends through the armature 2. This first magnetic circuit is closed through the magnet supports 16 and the short sleeve 15 which are again fabricated from soft magnetic alloys.

A second magnetic circuit comprises signal coil 4, coil core 13, long sleeve 14, the magnet support 16, the armature 2 and the shaft 12. Signal coil 4 is connected to lead 11 by virtue of feedthrough 9. Preferably, all elements forming the second magnetic circuit other than the signal coil 4 are made of soft magnetic alloys to conduct the signal flux generated by coil 4. This magnetic signal circuit includes two air gaps: the working gap 17*b* and a transverse gap 18 formed between the coil core 13 and the shaft 12. The transverse gap 18 between the coil core 13 and shaft 12 is minimized in order to provide a low reluctance thereby minimizing losses in the magnetic circuit.

In operation, the signal flux passing through the working gap 17*b* has the effect of modulating the polarizing flux generated by the magnets 3*a* and 3*b* in the process either increasing or decreasing the flux in the working gap 17*b* depending on the direction of the current passing through the signal coil 4. This in turn increases or decreases the attractive force in gap 17*b* compared to the constant polarizing flux in gap 17*a* which results in a net force pulling the armature upwards or downwards. In this manner, small changes in the signal flux generated by coil 4 will result in corresponding actuation of shaft 12 thereby providing an electromechanical actuator of enhanced sensitivity.

Further details of the above DACS actuator and other associated embodiments are described in PCT Application No. PCT/AU2005/001801 (WO 2006/058368) entitled IMPLANTABLE ACTUATOR FOR HEARING AID APPLICATIONS, published 8 Jun. 2006 and which is hereby incorporated by reference in its entirety.

Figure 3:
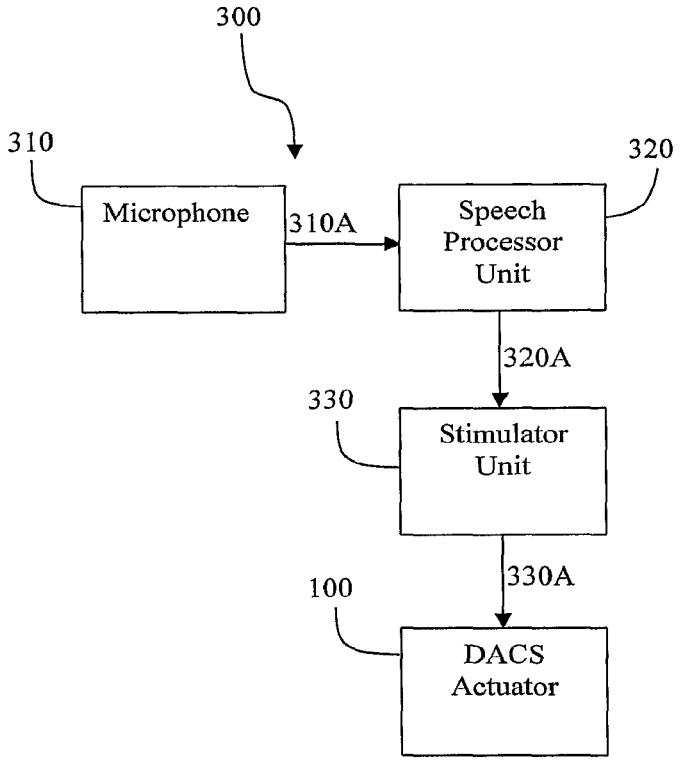
Figure 3 (prior art)
FIG. 3 is a system overview diagram of an implantable hearing aid device incorporating the DACS actuator illustrated in FIGS. 1 and 2.

Referring now to FIG. 3, there is shown a system overview of one example of an implantable hearing aid device or DACS actuator system 300 incorporating a DACS actuator 100 such as illustrated in FIGS. 1 and 2. The term implantable hearing aid device 300 is taken throughout the specification to mean a hearing aid device having one or more components which are implanted within a recipient.

Implantable hearing aid device 300 includes a microphone 310 which may be implanted or alternatively is located externally in a suitable location such as close to the outer ear of the recipient. The microphone output signal 310A is processed by speech processor unit 320 which once again may be an implanted component or alternatively be located external to the recipient in a location such as behind the ear of the recipient. Speech processor unit 320 generates coded signals 320A which are further processed by stimulator unit 330 which typically is an implanted component and which generates stimulation signals 330A which drive DACS actuator 100. Where for example the speech processor unit 320 is located externally and the stimulator unit 330 is implanted, a radio receiver arrangement (not shown) may be employed to transmit information from the speech processor unit 320 to the stimulator unit 330.

Stimulation signals 330A are generated based on the microphone output signal 310A, a hearing impairment profile which characterises the hearing loss of the recipient of the implantable hearing device 300 and the transfer function of DACS actuator 100 which has a resonance peak of approximately 1 kHz. Typically, the hearing impairment profile is utilised by the speech processor unit 320 to generate coded signals 320 and the transfer function of DACS actuator 100 is utilised by the stimulator unit 330 when generating stimulation signals 330A as it characterises the physical behaviour of the actuator. However, as would be apparent to those of ordinary skill in the art, the various stages of processing may be undertaken separately or in combination to varying degrees according to the requirements of implantable hearing aid device 300.

Figure 4:
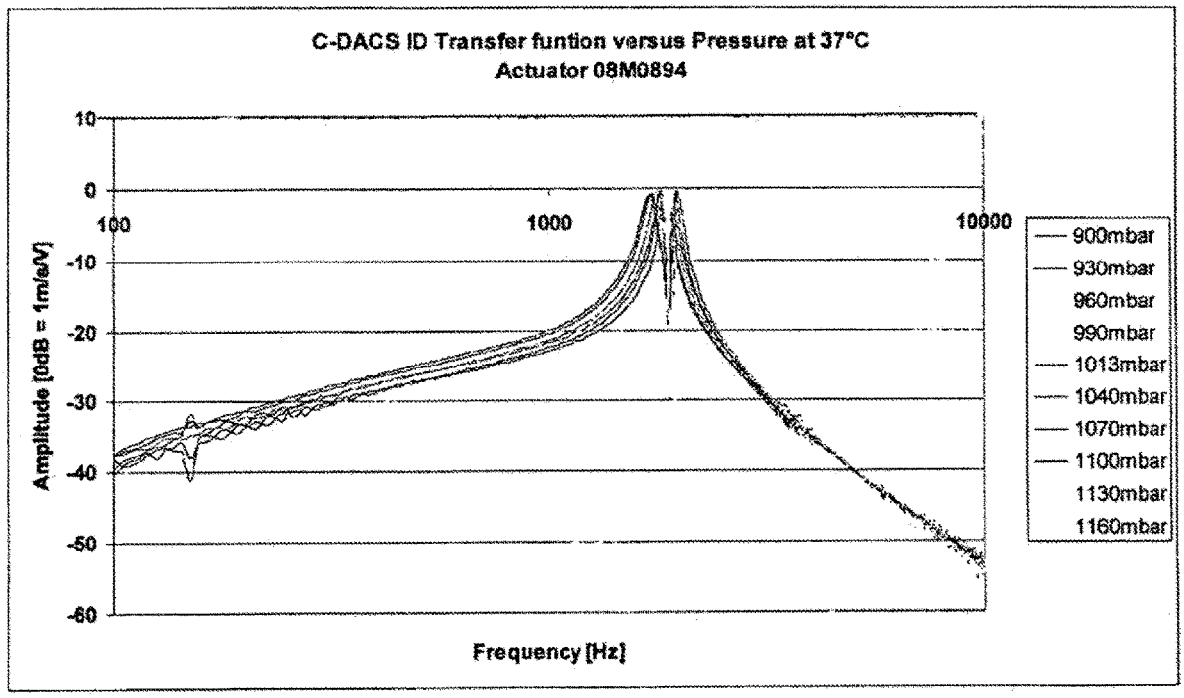
FIG. 4 is a plot of the amplitude transfer function (i.e. amplitude vs frequency) of a DACS actuator of the type illustrated in FIG. 1 depicting the change in performance of the actuator as a function of external pressure.

Referring now to FIG. 4 there is shown is a plot of the amplitude transfer function (i.e. amplitude versus frequency) of a DACS actuator of the type illustrated in FIGS. 1 and 2 depicting the change in the resonance behaviour of the actuator 100 as a function of external pressure. As has been determined by the applicant here, the resonance peak of DACS actuator 100 will vary according to local pressure conditions which will govern the external pressure experienced by DACS actuator. In FIG. 4, the internal pressure within sealed housing 1 of DACS actuator 100 is 1013 mbar and the variation of the amplitude transfer function is plotted for external pressures ranging from 900 mbar to 1160 mbar.

This variation in the transfer function is primarily due to the housing 1 of DACS actuator 100 being sealed, thereby preventing equalisation of pressure between the inside and outside of housing 1. Because of this imbalance in pressure between the inside and outside of housing 1 an associated imbalance in the location of the armature 2 results which then affects the resonance frequency of the device as depicted in FIG. 4. As such, any gain compensation directed to the position and structure of the initial resonance peak will now be directed towards an incorrect resonance characterisation resulting in suboptimal performance of DACS actuator 100 and in turn hearing aid device 300.

Figure 5:
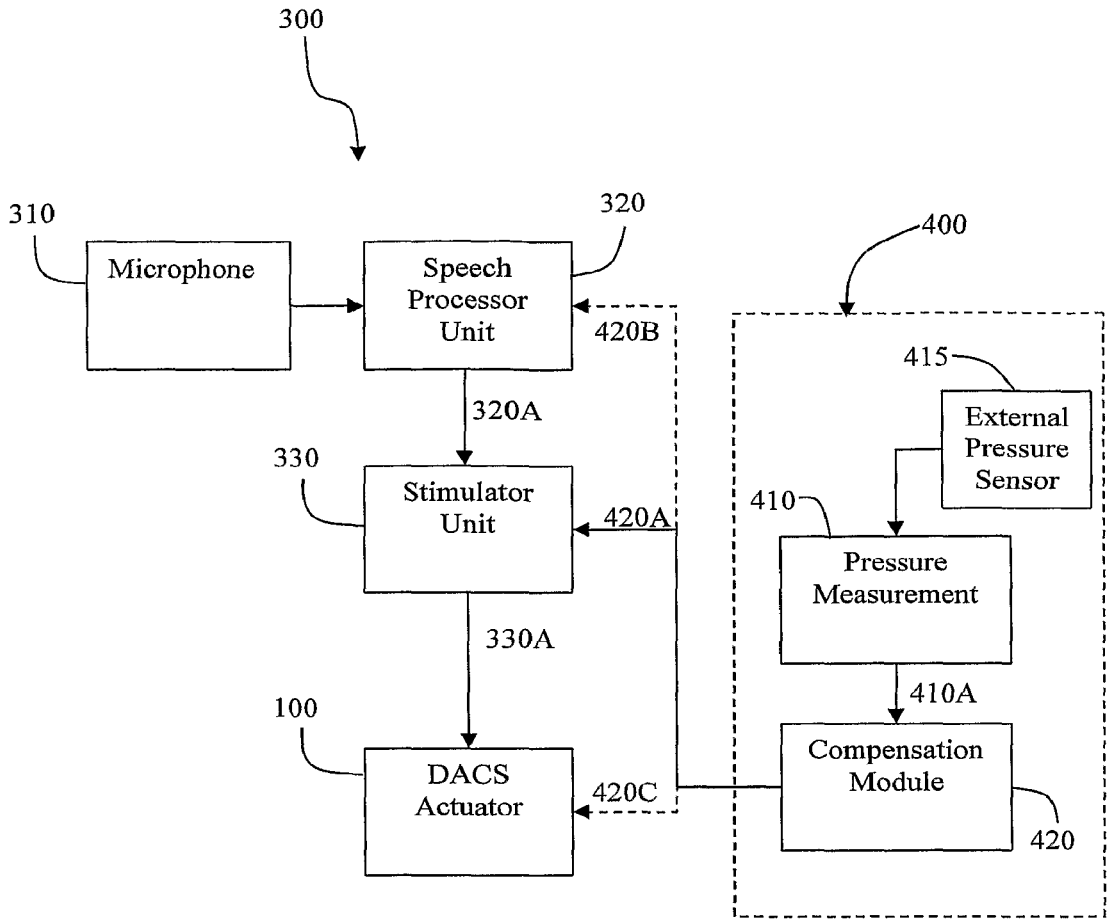
FIG. 5 is a system overview diagram of a compensation system for an implantable actuator such as the DACS actuator system illustrated in FIG. 3 in accordance with a first illustrative embodiment.

Referring now to FIG. 5, there is shown a system overview diagram of the implantable hearing aid device 300 incorporating a DACS actuator 100 further including a compensation system 400 in accordance with an illustrative embodiment. Compensation system 400 includes a pressure measurement means 410 for measuring an external pressure 410A outside of housing 1 and compensation means or module 420 for determining a compensation factor 420A based on the measured external air pressure 410A.

In this illustrative embodiment, pressure measurement means 410 includes an external pressure sensor located 415 outside of the sensor housing 1 to measure external pressure. External pressure sensor 415 may be located at any suitable location. As an example, the external pressure sensor 415 may form part of or be integrated with the DACS actuator 100 and be located on the outer surface of housing 1 with associated sensor electronics located within housing 1 and electronically communicated to stimulator unit by actuator lead 11. In another illustrative embodiment, the external pressure sensor 415 is located with or integrated with another of the implanted components such as the stimulator unit 330. In yet another illustrative embodiment, the external pressure sensor is a separate implantable component.

Alternatively, the external pressure sensor 415 may be located with or integrated with the external microphone 310 or in another embodiment be located with or integrated with the external speech processor unit 320 which may be implemented as a behind the ear (BTE) component. In another alternative embodiment, external pressure sensor 415 may be implemented as the only external component (i.e. to be used externally to the recipient) of an otherwise fully implanted hearing aid device or more generally an implantable actuator with pressure information transmitted by wireless link to one of the implanted components. In this illustrative embodiment, the external pressure sensor may be worn by the recipient or located in the general environment of the recipient. In another alternative, there may be a plurality of pressure sensors employed to measure the external pressure outside of housing 1.

As depicted figuratively in FIG. 4, compensation module 420 determines a compensation factor 420A which is directed to stimulator unit 330 and combined with stimulator signal 330A to adjust the driving arrangement 50 of DACS actuator 100 to compensate for variations in the external pressure outside of housing 1. In this illustrative embodiment, compensation factor 420A may take the form of a modified transfer function such as depicted in FIG. 4 based on the measured external pressure and an assumed internal pressure for the housing 1 of 1013 mbar. As an example, if the measured external pressure is 1100 mbar then the associated transfer function corresponding to that value would be determined by compensation module 420 and employed by stimulator unit 330. This information may be stored or retrieved by means of a look up table (LUT) or by suitable interpolation coefficients depending on the requirements. In this manner, stimulator unit 330 will generate stimulation signals 330A based on the true transfer function of DACS actuator 100 as opposed to an assumed transfer function as is the case with prior art devices.

Compensation factor 420A may also incorporate separate components 420B, 420C (shown in dashed lines) directed to speech processor unit 320 and DACS actuator 100 respectively. In one embodiment, the physical operating characteristics of DACS actuator 100 are modified based on compensation factor 420C to adjust the resonance behaviour back to its original form. As an example, this may be achieved by applying a DC signal and/or an asymmetrical AC signal to signal coil 4 in accordance with compensation factor 420C. Equally, depending on requirements, compensation factors may be directed to any component or combination of components of hearing aid device 300. Similarly, the compensation module 420 or processor that determines the compensation factor(s) may be located separately or in combination with in any one of the components of the hearing aid device 300.

Figure 6:
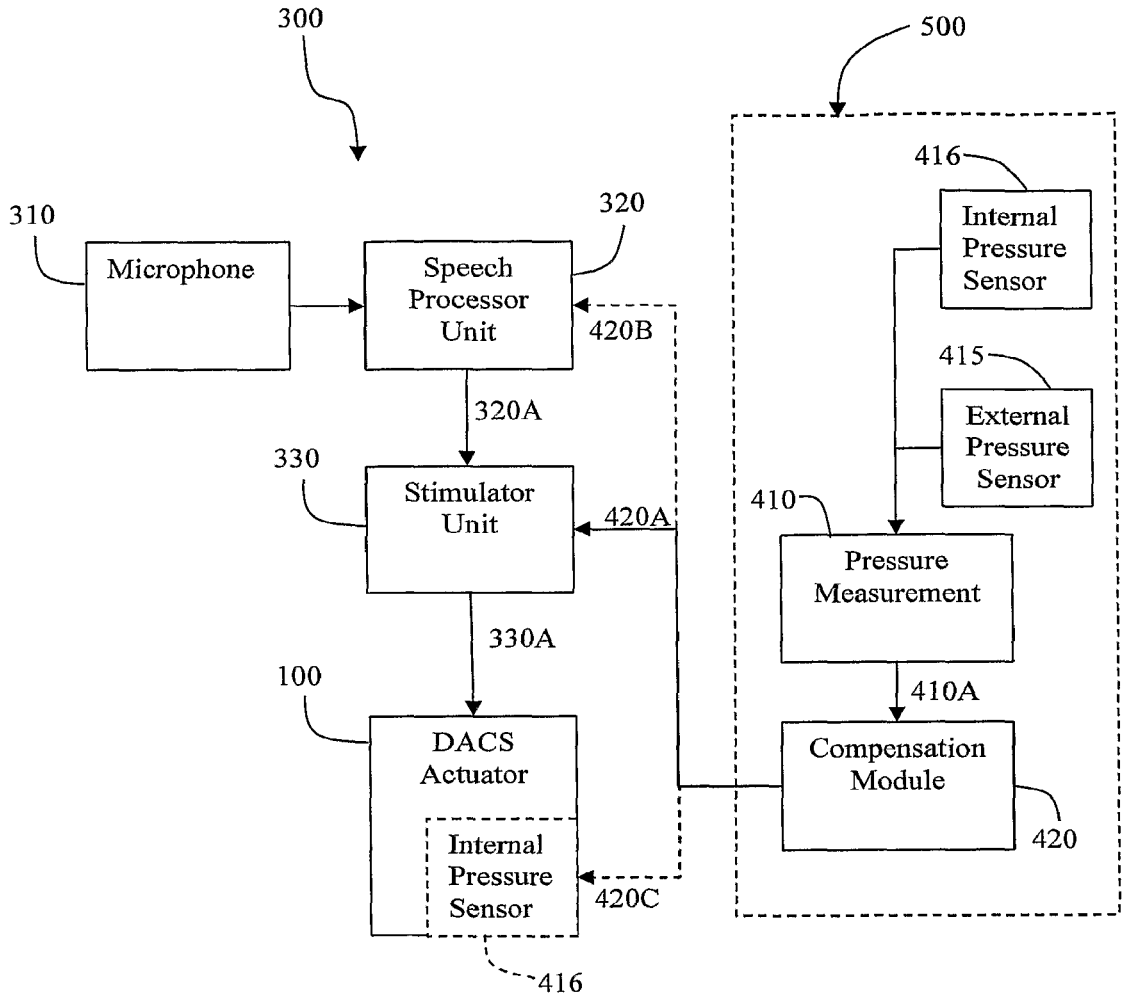
FIG. 6 is a system overview diagram of a compensation system for an implantable actuator such as the DACS actuator system illustrated in FIG. 3 in accordance with a second illustrative embodiment.

Referring to FIG. 6, there is shown a system overview diagram of the implantable hearing aid device 300 incorporating a DACS actuator 100 further including a compensation system 500 in accordance with a further illustrative embodiment. In this illustrative embodiment, compensation system 500 further includes an internal pressure sensor 416 located inside of housing 1 (as also shown in dashed outline) to measure internal pressure. Although the internal pressure is not expected to vary greatly as housing 1 is sealed, there may be some pressure drift expected due to the increasingly longer lifetimes that are being achieved with implantable devices (i.e. greater than 60 years) and the potential for outgassing of components. In addition, the internal pressure may vary in accordance with temperature. In yet another illustrative embodiment, a differential pressure sensor is employed having an external pressure sensing region directed outside of housing 1 and an internal pressure sensing region located inside of housing 1.

In these illustrative embodiments, the compensation factor 420A (and 420B, 420C where appropriate) will be based on both the external pressure and the internal pressure. As an example, the transfer functions depicted in FIG. 4, which are based on an assumed value of 1013 mbar for the internal pressure, will now also include a term or free parameter dependent on the internal pressure measured in housing 1 which will further alter the characteristics of the transfer function. Accordingly, a modified transfer function will be determined dependent on both the external pressure and the internal pressure. This modified transfer function may then be used to compensate the DACS actuator 300 for variations in both the external and internal pressure relative to the housing as referred to above.

A further situation where the compensation system and method will be effective to compensate for differences between the external and internal pressure relative to the housing is where a recipient having a fully implantable or semi-implantable actuator incorporating waterproof external parts may be swimming or otherwise underwater. In another illustrative embodiment directed to circumstances where the external pressure may be relatively stable and the internal pressure is expected to vary such as would be expected with potential internal temperature variation, the compensation factor may be based only on the internal pressure.

Figure 7:
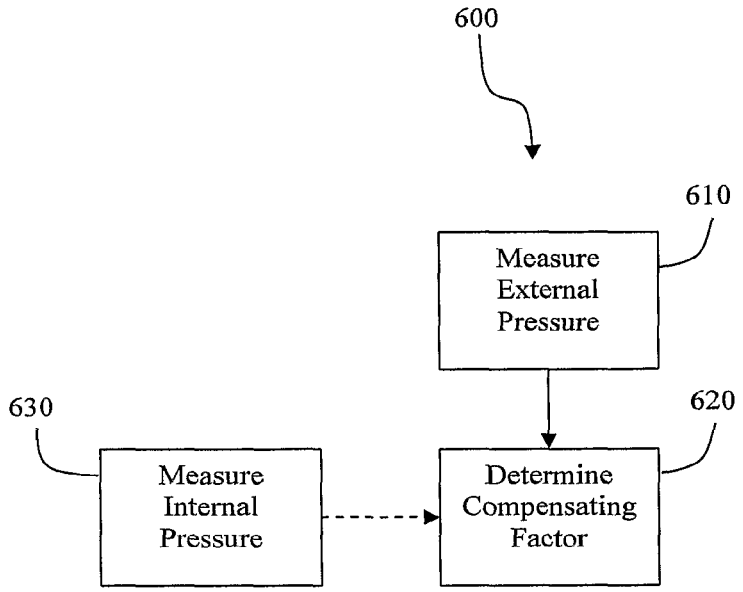
FIG. 7 is a method flowchart diagram of a method for compensating an implantable actuator according to further illustrative embodiments.

Referring now to FIG. 7, there is shown a method flowchart of a method 600 for compensating an implantable actuator for pressure variations according to further illustrative embodiments. At step 610, the external pressure outside of the sealed housing of the actuator is measured by an external pressure sensor as has been previously described. At step 620, a compensation factor is determined which in one illustrative embodiment is based on the external pressure measured at step 610. In another illustrative embodiment, the compensation factor determined at step 620 is based on measuring the internal pressure within the sealed housing at step 630. In yet another illustrative embodiment, the compensation factor determined at step 620 is determined based on both the measured internal pressure and external pressure. As has been described previously, the compensation factor may be in the form of a modified transfer function for the implantable actuator.

As would be apparent to one of ordinary skill in the art, while the compensation system and method has been described in relation to a DACS stimulator it will be appreciated that the compensation system and method will have application to other implantable actuators consistent with the principles described in the specification. Some example actuators where the compensation system and method may be applicable include implantable drug delivery systems or microphones incorporating sealed housings.

Pressure sensors of any suitable type may be used including but not limited to those based on the measurement of an applied force over a predetermined area such as by the use of a diaphragm, piston, tube or bellows arrangement in combination with an electronic measuring arrangement which may be based on one or more of the following physical principles including but not limited to piezo resistive or electric, capacitive, electromagnetic, optical, thermal conductive, resonant or potentiometric effects.

Those of skill in the art would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality.

Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

It will be understood that the term "comprise" and any of its derivatives (e.g. comprises, comprising) as used in this specification is to be taken to be inclusive of features to which it refers, and is not meant to exclude the presence of any additional features unless otherwise stated or implied.

The reference to any prior art in this specification is not, and should not be taken as, an acknowledgement of any form of suggestion that such prior art forms part of the common general knowledge.

Although illustrative embodiments have been described in the foregoing detailed description, it will be understood that the invention is not limited to the embodiment disclosed, but is capable of numerous rearrangements, modifications and substitutions without departing from the scope of the invention as set forth and defined by the following claims.

The invention claimed is:

1. A system, comprising:

a sensor arrangement configured to determine an external pressure outside of a housing containing at least a portion of a transducer, the housing and transducer being implantable; and an electronic apparatus configured to evaluate input from the sensor arrangement and output a signal based at least in part on the input, wherein the system is configured to control the implantable transducer based at least in part on the outputted signal.

2. The system of claim 1, wherein the system includes the transducer, wherein the transducer is an implantable actuator, and wherein the system is configured so that the outputted signal is used at least in part to drive a driving arrangement of the implantable actuator, the driving arrangement corresponding to the portion of the transducer contained in the housing.

3. The system of claim 1, wherein the system further includes an internal pressure sensor for measuring an internal pressure within the housing.

4. The system of claim 3, wherein the electronics apparatus is configured to determine an adjustment parameter based on both the external pressure and the internal pressure, and wherein the system is configured to utilize the adjustment parameter to develop at least in part the outputted signal.

5. The system of claim 3, wherein the electronics apparatus is configured to determine a compensation factor based on the internal pressure.

6. The system of claim 1, wherein the electronics apparatus is configured to determine an adjustment parameter in the form of a modified transfer function for the implantable transducer.

7. The system of claim 1, wherein the system includes an external pressure sensor configured to determine the external pressure, wherein the external pressure sensor is an external component configured to be used externally to the recipient of the implantable transducer.

8. The system of claim 1, wherein the implantable transducer further includes one or more external components configured to be used externally to the recipient of the implantable transducer, and wherein the sensor system is integrated into one or more of the external components of the implantable transducer.

9. An implantable actuator including the system of claim 1.

10. A method, comprising:

transducing energy using an implanted transducer during a first temporal period, wherein at least a portion of the transducer is located in a housing that is implanted in a recipient; and transducing energy using the implanted transducer during a second temporal period, wherein the housing continues to be implanted in the recipient, wherein a pressure external to the housing is different during the second temporal period relative to that which is the case during the first temporal period, and the method further comprises influencing operation of the implanted transducer based at least in part on the difference in the external pressure.

11. The method of claim 10, further comprising:

determining an adjustment parameter for the implanted transducer, the adjustment parameter being based on the pressure external to the housing, and influencing the operation of the transducer based on the adjustment parameter.

12. The method of claim 10, further comprising:

measuring the pressure external to the housing during the second temporal period, and based on the measured pressure external to the housing, determining that there exists the difference in external pressure, wherein the action of influencing operation of the transducer is executed at least in part based on the determination that there exists the difference in external pressure.

13. The method of claim 10, further comprising:

determining a pressure within the housing; and the action of influencing operation of the implanted transducer includes adjusting operation of such based on the determined pressure within the housing and the pressure external to the housing.

14. The method of claim 10, further comprising:

determining pressure external to the housing during the second temporal period; and based on the determined pressure external to the housing during the second temporal period, compensating the implanted transducer based on the determined pressure external to the housing during the second temporal period.

15. The method of claim 10, wherein:

the implanted transducer is an implanted microphone.

16. An implantable medical device, comprising:

a housing configured to be implanted in a recipient; and means for harmonizing operation of a component of the medical device in an event of a pressure change ambient the housing.

17. The implantable medical device of claim 16, wherein:

the component is a component having a performance that is impacted by a change in the pressure differential between pressure outside of the housing and pressure inside the housing in the absence of operation of the means for harmonizing operation; and the means for harmonizing operation develops a factor that when utilized renders the performance of the component the same after the change in a pressure differential between pressure outside of the hosing and pressure inside the housing.

18. The implantable medical device of claim 16, wherein:

the component is an implantable microphone.

19. The implantable medical device of claim 16, wherein:

the component is a transducer having an electromagnet assembly that moves during transduction; and the electromagnet assembly is located in the housing.

20. The implantable medical device of claim 19, wherein:

the means for harmonizing operation develops a compensation factor for the electromagnet assembly.

* * * * *